United States Patent [19]

Robinson et al.

[11] 4,054,421

[45] Oct. 18, 1977

[54] METHOD FOR DESULFURIZING CHAR BY ACID WASHING AND TREATMENT WITH HYDROGEN GAS

[75] Inventors: Leon Robinson, Upland; Allan Sass, Los Angeles, both of Calif.

[73] Assignee: Occidental Research Corporation, La Verne, Calif.

[21] Appl. No.: 681,900

[22] Filed: Apr. 30, 1976

Related U.S. Application Data

[63] Continuation of Ser. No. 541,175, Jan. 15, 1975, abandoned, which is a continuation of Ser. No. 461,897, April 18, 1974, abandoned.

[51] Int. Cl.[2] ..... C10L 9/10; C10B 57/00

[52] U.S. Cl. ..... 44/1 F; 44/1 R; 201/17

[58] Field of Search ..... 44/1 R, 1 F; 201/17

[56] References Cited

U.S. PATENT DOCUMENTS

| | | | |
|---|---|---|---|
| 3,214,346 | 10/1965 | Mason et al. | 44/1 F |
| 3,251,751 | 5/1966 | Lindahl et al. | 201/17 X |
| 3,812,017 | 5/1974 | Santangelo et al. | 201/17 |

FOREIGN PATENT DOCUMENTS

| | | | |
|---|---|---|---|
| 453,072 | 9/1936 | United Kingdom | 201/17 |

*Primary Examiner*—Carl F. Dees

*Attorney, Agent, or Firm*—Fulwider, Patton , Rieber, Lee & Utecht

[57] ABSTRACT

This invention covers a process for reducing the sulfur content of char by washing the char with an acid followed by treatment with hydrogen gas.

8 Claims, No Drawings

METHOD FOR DESULFURIZING CHAR BY ACID WASHING AND TREATMENT WITH HYDROGEN GAS

This is a continuation of application Ser. No. 541,175, filed Jan. 15, 1975, which is a continuation of application Ser. No. 461,897, filed Apr. 18, 1974 both now abandoned.

BACKGROUND OF THE INVENTION

Present methods commercially employed for the desulfurization of chars, such as those made from coal, only remove a portion of the sulfur present therein. This is inadequate for purposes of complying with air purity standards which limit the amount of sulfur dioxide produced by the combustion of coals, chars, and other carbonaceous materials. The need for a relatively sulfur-free char, and especially a coal char, has therefore become very important, especially in view of the abundant supplies of coal and the dwindling supplies of oil and natural gas.

One desulfurization method used on coal is to treat the coal with hydrogen gas to react with the sulfur in the coal to form hydrogen sulfide gas. This method may work well with coal but not as well with chars made from coal because the sulfur appears to be more resistant to reaction with hydrogen after being converted into char.

A further problem in treating coal or char with hydrogen gas is that trace amounts of hydrogen sulfide in the hydrogen gas will inhibit desulfurization or back-react with the coal or char to increase its sulfur content. Hydrogen gas used in coal or char desulfurization methods is usually recycled and will contain small amounts of hydrogen sulfide and other sulfur-bearing gases produced during desulfurization. Attempts may be made to remove the sulfur-bearing gases from the hydrogen before recycling, but such attempts are not too successful unless the gases are subjected to more elaborate and expensive separation techniques. As a result, the hydrogen used for desulfurization purposes may contain small amounts of sulfur-bearing gases and when it does, desulfurization is inhibited or a back reaction may occur to increase the sulfur content of the coal or char. Consequently, in methods that do employ recycled hydrogen gas, it is important that all traces of sulfur-bearing gases be removed therefrom, which, as a practical matter is difficult to do.

SUMMARY OF THE INVENTION

It has been discovered that greatly improved results in desulfurizing char with hydrogen gas are realized if the char is first washed with an acid before treatment with the hydrogen gas. The acid washing is believed to make the sulfur in the char more reactive with hydrogen gas by reacting with the inorganic compounds therein to form metallic salts which are removed from the char in the acid wash. These inorganic compounds include sulfides, such as iron sulfide and calcium sulfide, and other inorganics which generally comprise the ash content of the char. The organic sulfur in the char is not believed to be effected by the acid wash but the removal of the inorganic compounds by the acid wash appears to make the organic sulfur more susceptible to removal by the instant invention.

It has further been discovered that when char is washed with an acid before treatment with hydrogen gas, the pressure of sulfur bearing gases, such as hydrogen sulfide, may be tolerated without any substantial inhibition to the desulfurization reaction.

It has also been discovered that pretreating char with acid before desulfurization with hydrogen gas will cause the desulfurization to proceed at a greater rate than in the absence of the acid pretreatment.

EMBODIMENT OF THE INVENTION

In practicing the method of the instant invention, coal is converted into char and thereafter introduced into an acid bath. The char need not be specially treated or prepared but may be introduced into the acid bath in the condition that it exists after it is manufactured. The acid bath is comprised of an aqueous solution of a mineral acid, such as for example, hydrochloric acid, sulfuric acid, nitric acid, phosphoric acid, or any combination thereof.

In the preferred embodiment, the acid concentration is one molar but may be as low as about 0.05 M. or lower if the residence time of the char in the acid is increased. The ratio of acid to char should be maintained at a level which will affect maximum reaction between the inorganic compounds present in the char and the acid. In the preferred embodiment, this ratio is at least two parts of a one molar aqueous solution of acid to one part of char. This ratio, however, may be varied depending upon the molarity of the acid and the residence time of the char in the acid. Thus, when the acid bath employs acids having relatively low molarities and long residence times, the acid to char ratio may have to be increased to effect the necessary reaction with the inorganics.

When the char is introduced into the acid bath, it is added therein by means of a motor-driven stirrer or other equivalent means which will provide a thorough mixing of the char with the aqueous acid solution for intimate contact therebetween. An inert medium, such as nitrogen gas, may be admixed into the char-acid mixture to eliminate the presence of oxygen therein and to prevent the possibility of any reactions therewith. The elimination of oxygen from the bath, however, is not necessary to the practice of the invention.

The acid bath may be maintained at room temperature but the rate of reaction with the inorganics will be increased if the bath is maintained at elevated temperatures. The residence time of the char in the acid bath should be at least about five minutes when using a one molar solution of acid at a ratio of about two parts of acid to one part of char. The residence time, however, like the acid-to-char ratio, is a variable depending on the acid concentration, bath temperature, and the acid-to-char ratio.

After the prescribed residence time, the char is removed by filtration from the aqueous acid bath. The char is thereafter washed with water to remove the acid therefrom. The inorganic salts formed by the reaction between the inorganic sulfides in the char and the acid are separated from the acid which is recycled for further use.

After the char has been washed with water as aforesaid, it is introduced into a reactor containing hydrogen gas maintained at a pressure of about 15 to 125 psia, at a temperature of between about 1100° to about 1800° F., and is held in said reactor from about one minute to about two hours. In the preferred embodiment, the char is treated with hydrogen gas at a pressure of about 65 psia and a temperature of about 1600° F. for about five minutes.

The hydrogen reacts with the sulfur in the char to form hydrogen sulfide, mercaptans and other sulfur-bearing gases. These sulfur-bearing gases and excess hydrogen are passed out of the reactor and the hydrogen is separated therefrom and recycled for further reaction with the char. Some trace amounts of hydrogen sulfide and other sulfur-bearing gases remain in the recycled hydrogen. After the char is washed with acid as aforesaid, the presence of these small amounts of sulfur-containing gases does not cause any reaction with the char to increase its sulfur content, and only slightly reduces the extent of char desulfurization by hydrogen gas. Up to about 3 to 5% of sulfur-containing gases in the hydrogen gas may be tolerated, depending upon the particular char, without impairing the commercial acceptability of the instant invention.

EXAMPLE I

To demonstrate the effect of acid washing on the desulfurization of char by hydrogen gas, 100 grams of Hamilton coal was converted into char by heating at 1600° F. for one hour. Hamilton coal is a high volatile, bituminous coal from seam No. 11 in Western Kentucky, and was beneficiated by floating the coal in a zinc chloride solution having a specific gravity of 1.55. The beneficiation is not necessary but it allows the pyritic sulfur ($FeS_2$), which has a specific gravity greater than 1.55, to settle out from the coal floating on the surface and thus reduces the amount of acid needed in the subsequent washing step. The char was ground and screened to −150 to +400 mesh. Eight, 10-gram specimens of char were prepared for treatment. Four of the specimens were not washed with any acid, and three of these specimens were treated in a fluidized bed quartz reactor at 1600° F., and 65 psia for four hours with hydrogen gas or a mixture of hydrogen sulfide-hydrogen gas as described in Table I hereinbelow. The four specimens were analyzed for their sulfur content and iron content and the results made noted as set forth in Table I.

Three of the remaining four specimens were washed with one liter of 1M HCl at 80° C. for five minutes. The char was separated therefrom and then washed a second time with 1 liter of 1M HCl for five minutes at 80° C. The char was separated after the second wash, washed with water to remove the acid therefrom, and treated in a fluidized bed quartz reactor at 1600° F. and 65 psi for four hours with hydrogen gas or mixture of hydrogen gas and hydrogen sulfide as set forth in Table I. The specimens were thereafter analyzed for their sulfur content and iron content and the results noted in Table I hereinbelow.

TABLE I

| Treatment of Char | Gas Used to Treat Char | Weight Percent of Sulfur in Char | Weight Percent Fe in Char | Weight Percent Ash in Char |
|---|---|---|---|---|
| Not washed with acid | None | 1.61 | 1.0 | 12.05 |
| Not washed with acid | $H_2$ | 0.58 | — | — |
| Not washed with acid | 1.1% $H_2S$ and 98.9% $H_2$ | 1.36 | — | — |
| Not washed with acid | 3.3% $H_2S$ and 96.7% $H_2$ | 1.82 | — | — |
| Washed with acid | None | 1.60 | 0.73 | 10.68 |
| Washed with acid | $H_2$ | 0.40 | — | — |
| Washed with acid | 1.1% $H_2S$ and 98.9% $H_2$ | 0.76 | — | — |
| Washed with acid | 3.3% $H_2S$ and 96.7% $H_2$ | 0.95 | — | — |

EXAMPLE II

To further demonstrate the effect of acid washing on the desulfurization of char by hydrogen gas, the procedures as set forth in Example I were repeated, except that a run of the mine type of Hamilton coal having a high ash, high sulfur and high iron content were used and the char was manufactured at 1400° F. and treated in the fluidized bed quartz reactor at 1400° F. The char was also analyzed for its ash content. The results are set forth hereinbelow in Table II.

TABLE II

| Treatment of Char | Gas Used to Treat Char | Weight Percent of Sulfur in Char | Weight Percent Fe in Char | Weight Percent Ash in Char |
|---|---|---|---|---|
| Not washed with acid | None | 2.87 | 2.12 | 14.24 |
| Not washed with acid | $H_2$ | 0.72 | — | 18.80 |
| Not washed with acid | 2.74% $H_2S$ and 97.26% $H_2$ | 2.22 | — | 18.07 |
| Washed with acid | None | 2.70 | 0.64 | 10.63 |
| Washed with acid | $H_2$ | 0.32 | — | 14.17 |
| Washed with acid | 2.74% $H_2S$ and 97.26% $H_2$ | 1.08 | — | 13.40 |

EXAMPLE III

To demonstrate the effect of acid washing in removing iron, calcium, and ash content of the char which comprises the total inorganic content of the char, the same Hamilton coal as described in Example I hereinabove was converted into char at 1600° F. for one hour under a nitrogen blanket in a fluidized quartz bed reactor. The char was ground to −200 mesh and three, 50-gram samples thereof were prepared. The first specimen was analyzed in terms of its ash, iron, and calcium content. The second specimen was mixed with 200 ml of 0.1M HCl and allowed to stand at room temperature for three hours. Thereafter the specimen was filtered from the acid and washed with water and analyzed in terms of its ash, iron and calcium content. The third specimen was added to 200 ml of 0.05M $H_2SO_4$ and allowed to stand at room temperature for three hours. Thereafter the char was filtered from the acid and washed with water and analyzed for its ash, iron and calcium content. The results are set forth in Table III hereinbelow.

TABLE III

| Treatment of Char | Weight Percent Fe in Char | Weight Percent Ca in Char | Weight Percent Ash in Char |
|---|---|---|---|
| Not washed with acid | 1.63 | 0.25 | 11.86 |
| Washed with HCl | 0.86 | 0.062 | 10.26 |
| Washed with $H_2SO_4$ | 0.88 | 0.062 | 10.14 |
| | 0.88 | 0.062 | 10.14 |

EXAMPLE IV

To demonstrate the effect of temperature upon the desulfurization of an acid washed char treated with hydrogen gas, the same Hamilton coal as used in Example I hereinbefore was converted into char and five specimens thereof were washed with HCl by the same procedure set forth in Example I. Four of the five acid-washed-char specimens were thereafter treated in a fluidized bed quartz reactor at 65 psi for four hours at five different temperatures as set forth in Table IV hereinbelow. Each of the specimens were thereafter analyzed for its sulfur content and the results are set forth in Table IV hereinbelow.

TABLE IV

| Temperature of $H_2$ Treatment ° F. | Weight Percent of Sulfur |
|---|---|
| Ambient Temperatures before $H_2$ Treatment | 1.82 |
| 1400 | 0.32 |
| 1500 | 0.24 |
| 1600 | 0.27 |
| 1700 | 0.33 |
| 1750 | 0.35 |

EXAMPLE V

To further demonstrate the effect of acid washing on the desulfurization of char by hydrogen gas, the same coal as used in Example I was converted into char in a pilot plant and thereafter subjected to the same procedures as set forth in Example I except that the char specimens were treated with hydrogen or the hydrogen-hydrogen sulfide gas mixtures at 1700° F. and at 50 psig.

To manufacture the char in the aforesaid pilot plant, the coal was pulverized to a size of approximately 80% −200 mesh. The coal was then pyrolyzed by contacting it with a circulating stream of heated char in a 4 inch diameter reactor. The temperature of the circulating char was approximately 1400° F. The resultant pyrolysis temperature was about 1100° F. at a coal feed rate of 50 lbs./hr. The reactor essentially consisted of a 20 foot long 4 inch diameter length of stainless steel pipe and the char and coal mixture flowed vertically upward through the tube at a velocity of approximately 20 ft./sec. Separation of gases and char was effected by a cyclone with the gases going to the liquid collection system.

The results of treating the char with hydrogen or the hydrogen-hydrogen sulfide gas mixtures are noted in Table V hereinbelow.

TABLE V

| Treatment of Char | Gas Used to Treat Char | Weight Percent of Sulfur in Char |
|---|---|---|
| Not washed with acid | $H_2$ | 1.62 |
| Not washed with acid | 0.4% $H_2S$ and 99.6% $H_2$ | 4.17 |
| Not washed with acid | 1.0% $H_2S$ and 99.0 % $H_2$ | 4.51 |
| Not washed with acid | 1.9% $H_2S$ and 98.1 % $H_2$ | 4.43 |
| Not washed with acid | 3.3% $H_2S$ and 96.7% $H_2$ | 4.85 |
| Washed with acid | $H_2$ | 0.1 |
| Washed with acid | 0.4% $H_2S$ and 99.6% $H_2$ | 0.25 |
| Washed with acid | 1.0% $H_2S$ and 99.0% $H_2$ | 0.45 |
| Washed with acid | 1.9% $H_2S$ and 98.1% $H_2$ | 0.5 |
| Washed with acid | 3.3% $H_2S$ and 96.7% $H_2$ | 0.68 |

EXAMPLE VI

To demonstrate the effect of acid washing on the rate of char desulfurization by hydrogen, a parallel set of char hydrodesulfurization tests were conducted using the same char and procedures described in Example I. In one test, the char specimen was treated with hydrogen at a temperature of 1600° F. for a period of five minutes. The test was then repeated with a char specimen which had been acid washed in advance of the hydrodesulfurization. The results are summarized below and indicate that the acid washing treatment significantly enhances the rate of char hydrodesulfurization.

| Sample | Quantity of Sulfur Removed During A 5-minute Treatment with $H_2$ Gas |
|---|---|
| Acid-treated char | 0.00086 lb. of sulfur/$Ft^3$ of $H_2$ |
| Untreated char | 0.00011 lb. of sulphur/$Ft^3$ of $H_2$ |

While the embodiments and examples set forth herein are for the purpose of demonstrating the instant invention, it is to be understood that this invention is not limited to said embodiments and examples but covers all changes and modifications thereof which fall within the spirit and scope of the invention. It is also to be understood that, while this invention has been described in relation to the treatment of coal chars, the invention is not limited thereby but comprehends the desulfurization of chars made from any carbonaceous material.

What we claim as our invention is:

1. In a method for desulfurizing char, the steps comprising:

a. washing the char with an acid to react with and leach-out the inorganic compounds therein, b. substantially removing said acid and said leached-out inorganic compounds formed in step (a) from said char, and c. desulfurizing said acid washed char by treatment with a gas comprising hydrogen.

2. In a method as set forth in claim 1, wherein said gas is comprised of hydrogen and lesser amounts of sulfur-bearing gases.

3. In a method as set forth in claim 1, wherein said char is washed with said acid for at least about one minute, and said acid is an aqueous mineral acid having a concentration of at least about 0.05 M., and is used for said wash at a ratio of at least about two parts of acid for every part of char.

4. In a method as set forth in claim 3, wherein said gas is comprised of hydrogen and lesser amounts of sulfur-bearing gases.

5. In a method for desulfurizing char, the steps comprising:

a. washing said char with an aqueous mineral acid in a concentration of at least 0.05 M. for at least about five minutes and in a ratio or at least about two parts of acid to about one part of char to react with and leach-out the inorganic compounds therein, b. substantially removing said acid and said leached-out inorganic compounds formed in step (a) from said char, and c. desulfurizing said acid washed char by treatment with a gas comprising hydrogen.

6. In a method as set forth in claim 5, wherein said gas is comprised of hydrogen and lesser amounts of sulfur-bearing gases.

7. In a method as set forth in claim 5, wherein said acid concentration is about 1 M, and the treatment with said gas is at a pressure of about 65 psia at a temperature of about 1600° F. for about five minutes.

8. In a method as set forth in claim 7, wherein said gas is comprised of hydrogen and lesser amounts of sulfur-bearing gases.

* * * * *